US009033674B2

(12) United States Patent
Jang et al.

(10) Patent No.: US 9,033,674 B2
(45) Date of Patent: May 19, 2015

(54) PROPELLER FAN AND AIR CONDITIONER HAVING THE SAME

(71) Applicant: Samsung Electronics Co., Ltd., Suwon-si (KR)

(72) Inventors: Keun Jeong Jang, Seoul (KR); Byung Ghun Kim, Suwon-si (KR); Jong Moon Kim, Hwaseong-gun (KR); Young Jae Kim, Yongin-si (KR); Hyeong Joon Seo, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/930,734

(22) Filed: Jun. 28, 2013

(65) Prior Publication Data

US 2014/0119938 A1 May 1, 2014

(30) Foreign Application Priority Data

Oct. 31, 2012 (KR) ..... 10-2012-0121930

(51) Int. Cl.

| | |
|---|---|
| ***F04D 29/34*** | (2006.01) |
| ***F04D 29/38*** | (2006.01) |
| ***F01D 5/14*** | (2006.01) |
| ***F01D 5/28*** | (2006.01) |
| ***F04D 29/32*** | (2006.01) |

(52) U.S. Cl.

CPC ..... *F01D 5/147* (2013.01); *F01D 5/282* (2013.01); *F04D 29/329* (2013.01)

(58) Field of Classification Search

CPC ..... F01D 5/147; F04D 29/329

USPC ..... 416/244 R, 234, 248, 235, 236 R, 237, 416/DIG. 3, 223 R

See application file for complete search history.

(56) References Cited

U.S. PATENT DOCUMENTS

| | | | | | |
|---|---|---|---|---|---|
| 996,741 | A | * | 7/1911 | Wait | 416/210 R |
| 1,943,571 | A | * | 1/1934 | Williamson | 416/234 |
| 1,954,309 | A | * | 4/1934 | Cutolo | 416/200 R |
| 2,095,162 | A | * | 10/1937 | Wood | 416/234 |
| 2,173,397 | A | * | 9/1939 | Littlejohn | 416/182 |
| 2,346,552 | A | * | 4/1944 | Brotz | 416/236 R |
| 2,801,793 | A | * | 8/1957 | Kline | 416/93 R |
| 3,180,424 | A | * | 4/1965 | Serrindes | 416/22 |
| 3,551,070 | A | * | 12/1970 | Glucksman | 416/91 |

(Continued)

FOREIGN PATENT DOCUMENTS

| | | | |
|---|---|---|---|
| JP | 2000-002194 | | 1/2000 |
| JP | 2003130394 | A * | 5/2003 |

(Continued)

OTHER PUBLICATIONS

Translation of JP2003-130394.*

International Search Report issued Feb. 25, 2014 in International Patent Application No. PCT/KR2013/009652.

*Primary Examiner* — Dwayne J White

*Assistant Examiner* — Ryan Ellis

(74) *Attorney, Agent, or Firm* — Staas & Halsey LLP

(57) ABSTRACT

Provided is a propeller fan including a hub having an oval shape in an axial direction, a plurality of wings that extend from the hub, and at least one reinforcement rib that extends from the hub and is formed closer to a leading edge of each of the plurality of wings. Through this configuration, the propeller fan has blowing efficiency and stiffness, and the weight and material cost of the propeller fan can be reduced.

15 Claims, 8 Drawing Sheets

(56) References Cited

U.S. PATENT DOCUMENTS

| | | | | |
|---|---|---|---|---|
| 4,721,394 | A * | 1/1988 | Casto et al. | 366/343 |
| 5,066,196 | A * | 11/1991 | Morofushi | 416/241 A |
| 6,688,848 | B2 * | 2/2004 | Ohtsuka | 416/189 |

FOREIGN PATENT DOCUMENTS

| | | |
|---|---|---|
| KR | 10-2004-0065708 | 7/2004 |
| KR | 10-2008-0018838 | 2/2008 |
| KR | 10-2010-0013523 | 2/2010 |

* cited by examiner

PROPELLER FAN AND AIR CONDITIONER HAVING THE SAME

CROSS-REFERENCE TO RELATED APPLICATIONS

This application claims the priority benefit of Korean Patent Application No. 10-2012-121930, filed on Oct. 31, 2012 in the Korean Intellectual Property Office, the disclosure of which is incorporated herein by reference.

BACKGROUND

1. Field

Embodiments relate to a propeller fan as a kind of an axial-flow fan that forms the flow of air in an axial direction and an air conditioner having the same.

2. Description of the Related Art

In general, a propeller fan is a kind of an axial-flow fan that forms the flow of air in an axial direction by including a cylindrical hub to which a rotation shaft of a driving motor is coupled and a plurality of wings that extend to an outer side of the hub. Such a propeller fan is used in an outdoor unit of an air conditioner and can allow air to forcibly flow.

In this case, the hub formed in the center of the propeller fan receives torque from the rotation shaft of the driving motor and simultaneously stably supports the plurality of wings, thereby providing sufficient stiffness to the plurality of wings even when the propeller fan rotates at a high speed.

However, such a hub should have a comparatively large size so as to support the plurality of wings although it does not contribute to blowing efficiency. Thus, the weight of the propeller fan increases and thus material cost thereof increases.

Thus, a propeller fan in which a hub is omitted and a plurality of wings are successively connected to each other, has also been proposed. However, the propeller fan having no hub requires a high-priced material when the plurality of wings are formed so as to secure structural stiffness of the plurality of wings.

SUMMARY

In an aspect of one or more embodiments, there is provided a propeller fan in which the size of a hub is reduced while securing stiffness of a plurality of wings so that the weight of the propeller fan can be reduced and material cost thereof can be reduced, and an air conditioner having the same.

In an aspect of one or more embodiments, there is provided a propeller fan including: a hub that is configured to be coupled to a rotation shaft of a driving motor; and a plurality of wings that extend from the hub to an outer side of the hub and that is configured to form a flow of air in an axial direction, wherein the hub has an oval shape with a long radius and a short radius in the axial direction.

The propeller fan may further include at least one reinforcement rib that extends from the hub and protrudes from a surface of each of the plurality of wings.

Each of the wings may include a leading edge that is positioned in a front of a rotation direction, a trailing edge that is positioned in a rear of the rotation direction, and a tip edge that connects the leading edge and the trailing edge, the at least one reinforcement rib include a plurality of reinforcement ribs which may be spaced apart from each other by a predetermined distance successively in a direction from the leading edge to the trailing edge, and a distance between the leading edge and a reinforcement rib that is closest to the leading edge may be smaller than a distance between the trailing edge and a reinforcement rib that is closest to the trailing edge.

A virtual extension line of the long radius of the hub may cross the leading edge, and a virtual extension line of the short radius of the hub may cross the trailing edge.

If the long radius of the hub is Y and the short radius of the hub is X, the equation of $1.1X<Y<1.4X$ may be satisfied.

If the long radius of the hub is Y and a radius of a virtual smallest circle having a center of a rotation axis and including the wings in the virtual smallest circle is R1, the equation of $3.5Y<R1<6.5Y$ may be satisfied.

If a radius of a virtual smallest circle having a center of a rotation axis and including the wings in the virtual smallest circle is R1 and a radius of a virtual smallest circle having a center of the rotation axis and including the at least one reinforcement rib is R2, the equation of $0.33<R2/R1<0.45$ may be satisfied.

The at least one reinforcement rib may not be formed at a positive pressure side of the wing but may be formed only at a negative pressure side of the wing.

The plurality of wings may include a first wing and a second wing, and each of the first wing and the second wing may include a leading edge that is positioned in a front of the rotation direction, a trailing edge that is positioned in a rear of the rotation direction, and a tip edge that connects the leading edge and the trailing edge, and the leading edge of the first wing and the trailing edge of the second wing may not cross each other, and the trailing edge of the first wing and the leading edge of the second wing may not cross each other.

The hub may include a sidewall portion in which the plurality of wings extend.

The hub may include an axial coupling portion to which a rotation shaft of a motor is coupled, a cavity may be formed between the axial coupling portion and the sidewall portion, and the hub may include at least one support rib that connects the axial coupling portion and the sidewall portion.

The propeller fan may be integrally injection molded using a composite polypropylene (PP) resin.

In an aspect of one or more embodiments, there is provided is a propeller fan including: a plurality of wings each wing may have a leading edge that is positioned in a front of a rotation direction, a trailing edge that is positioned in a rear of the rotation direction, and a tip edge that connects the leading edge and the trailing edge, and the plurality of wings may form a flow of air in an axial direction; a hub may be configured to be coupled to a rotation shaft of a driving motor and may be configured to receive torque, the hub may have an oval shape with a long radius and a short radius in the axial direction, wherein the plurality of wings may extend from the hub and a virtual extension line of the long radius crosses the leading edge and a virtual extension line of the short radius crosses the trailing edge; and a plurality of reinforcement ribs that may extend from the hub and may protrude from the wings, wherein the plurality of reinforcement ribs may be formed closer to the leading edge than the trailing edge.

In an aspect of one or more embodiments, there is provided an air conditioner including: a body; a heat exchanger disposed in the body; a propeller fan that allows air inside the body to forcibly flow; and a driving motor that drives the propeller fan, wherein the propeller fan includes: a hub that is coupled to a rotation shaft of the driving motor; and a plurality of wings that extend from the hub to an outer side of the hub and form a flow of air in an axial direction, and the hub has an oval shape with a long radius and a short radius in the axial direction.

Each of the plurality of wings may include a leading edge that is positioned in a front of a rotation direction, a trailing edge that is positioned in a rear of the rotation direction, and a tip edge that connects the leading edge and the trailing edge, and a virtual extension line of the long radius of the hub may cross the leading edge, and a virtual extension line of the short radius of the hub may cross the trailing edge.

The air conditioner may further include at least one reinforcement rib that extends from the hub and protrudes from a surface of the wing.

In an aspect of one or more embodiments, there is provided a propeller fan which may include a hub coupled to a rotation shaft of a driving motor; a plurality of wings that extend from the hub to form a flow of air in an axial direction upon rotation of the rotation shaft, wherein the hub has an oval shape with a long radius and a short radius in the axial direction; a plurality of reinforcement ribs that extend from the hub and protrude from a surface of each of the plurality of wings, wherein each of the wings comprises a leading edge that is positioned in a front of a rotation direction, a trailing edge that is positioned in a rear of the rotation direction, and a tip edge that connects the leading edge and the trailing edge; and a distance between the leading edge and a reinforcement rib that is closest to the leading edge is smaller than a distance between the trailing edge and a reinforcement rib that is closest to the trailing edge.

The plurality of reinforcement ribs may be formed only at a negative pressure side of the wing.

The hub may include a sidewall portion in which the plurality of wings extend.

The hub may include an axial coupling portion to which the rotation shaft of the motor is coupled. A cavity may be formed between the axial coupling portion and the sidewall portion, and the hub may include at least one support rib that connects the axial coupling portion and the sidewall portion.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
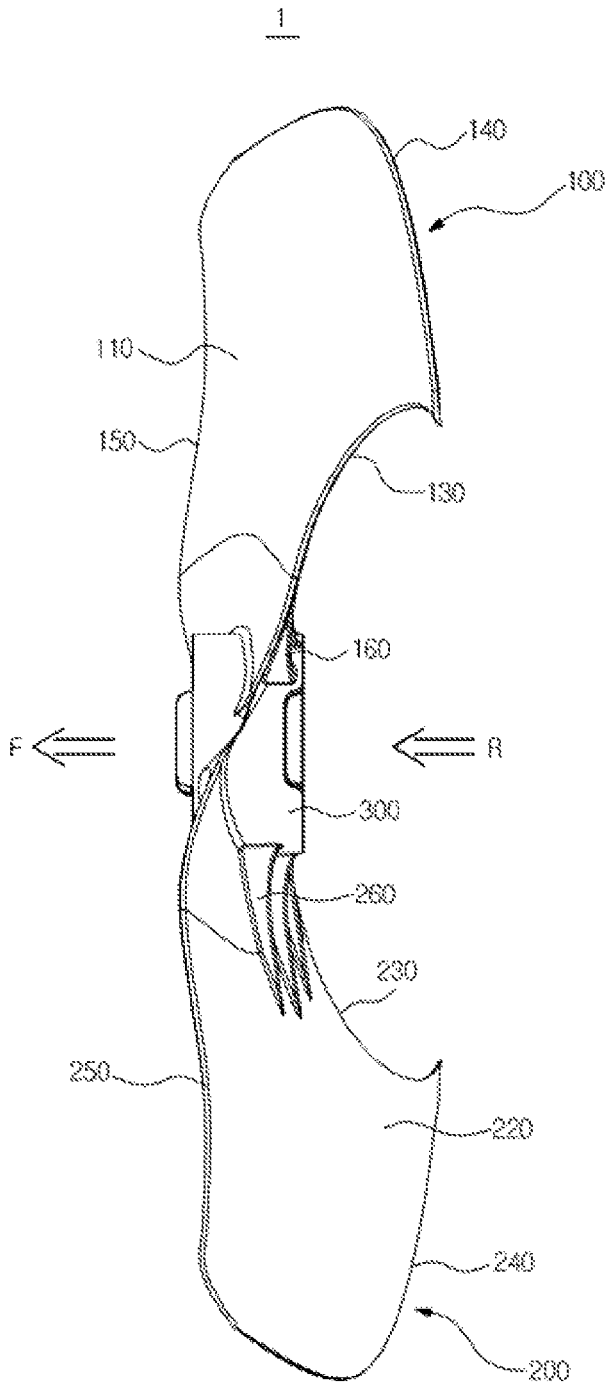
FIG. 1 is a side view of a propeller fan according to an embodiment.

Reference will now be made in detail to embodiments, examples of which are illustrated in the accompanying drawings, wherein like reference numerals refer to the like elements throughout. Embodiments are described below by referring to the figures.

Figure 2:
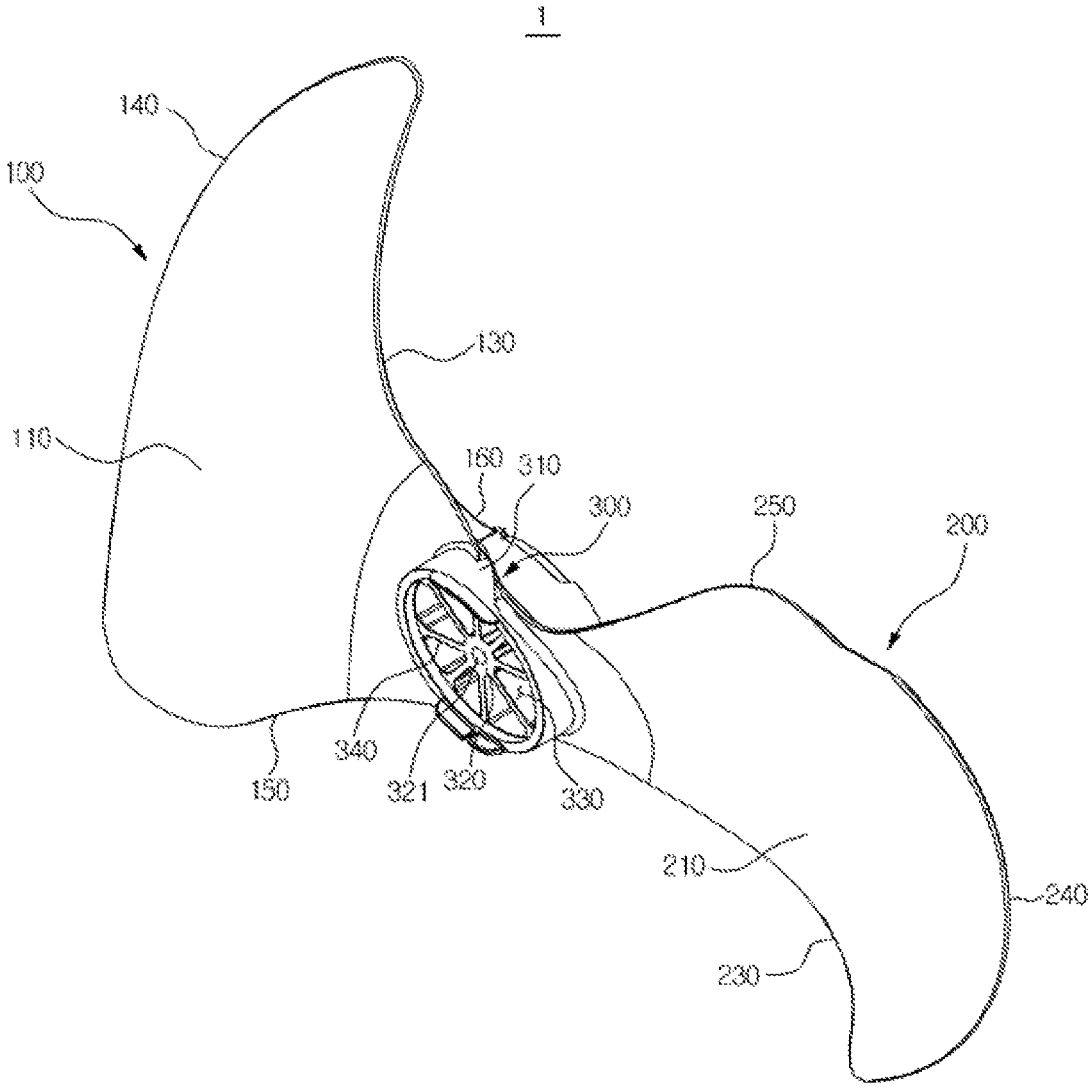
FIG. 2 is a front perspective view of the propeller fan illustrated in FIG. 1.
Figure 3:
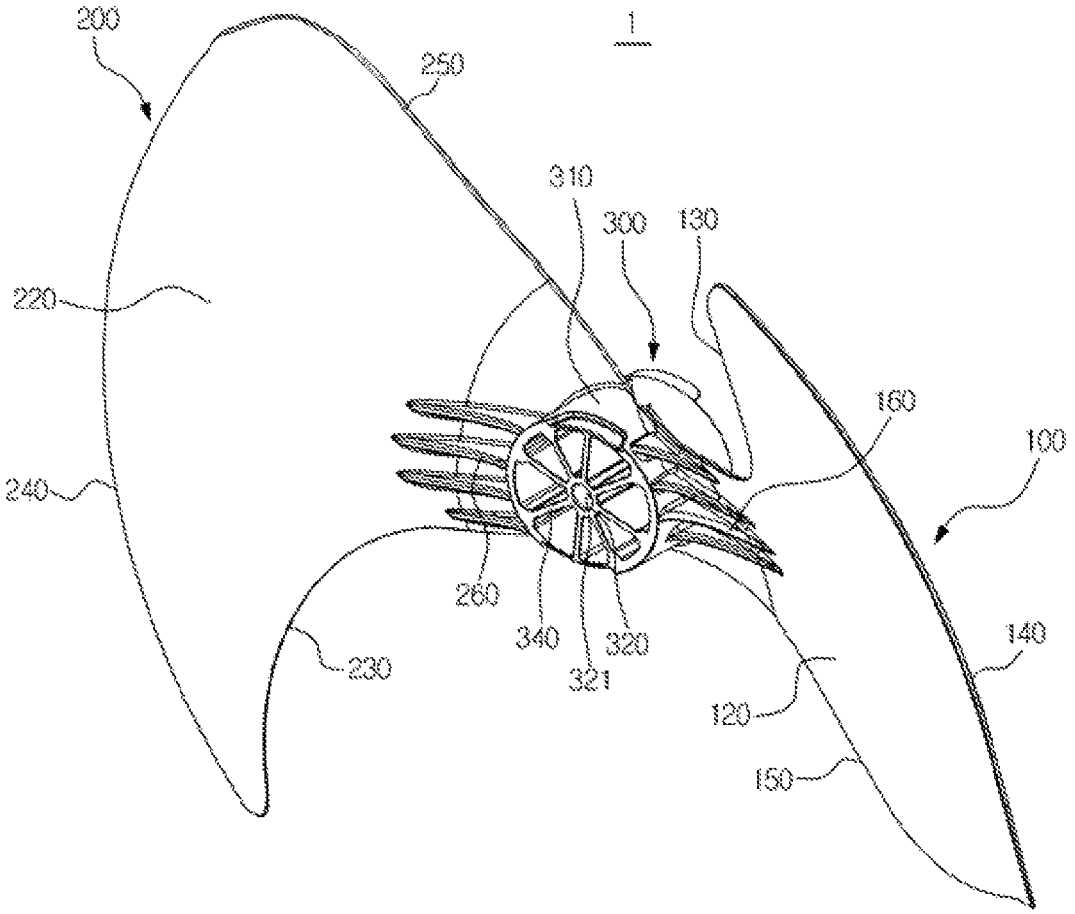
FIG. 3 is a rear perspective view of the propeller fan of FIG. 1.
Figure 4:
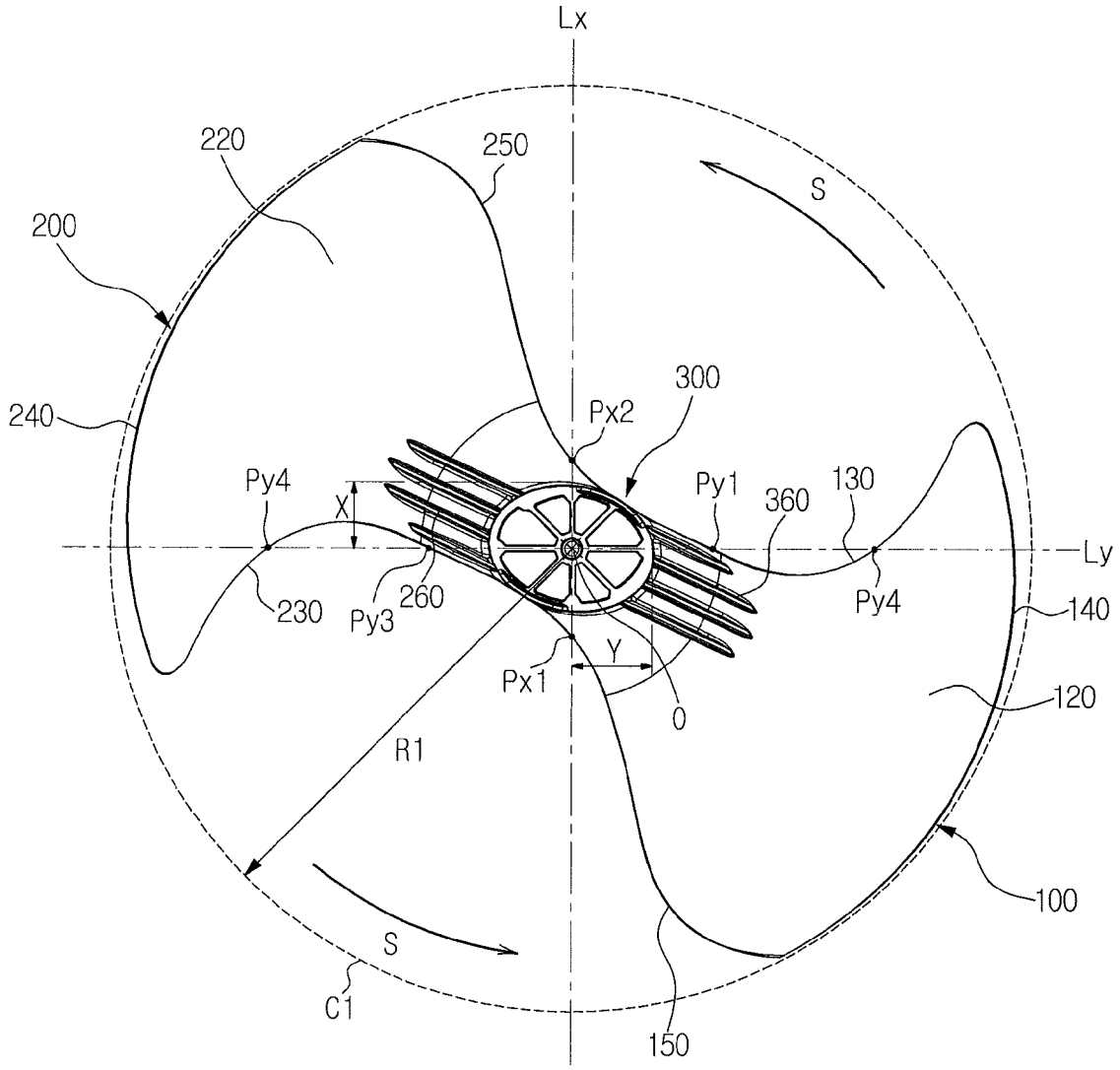
FIG. 4 is a rear view of the propeller fan of FIG. 1.
Figure 5:
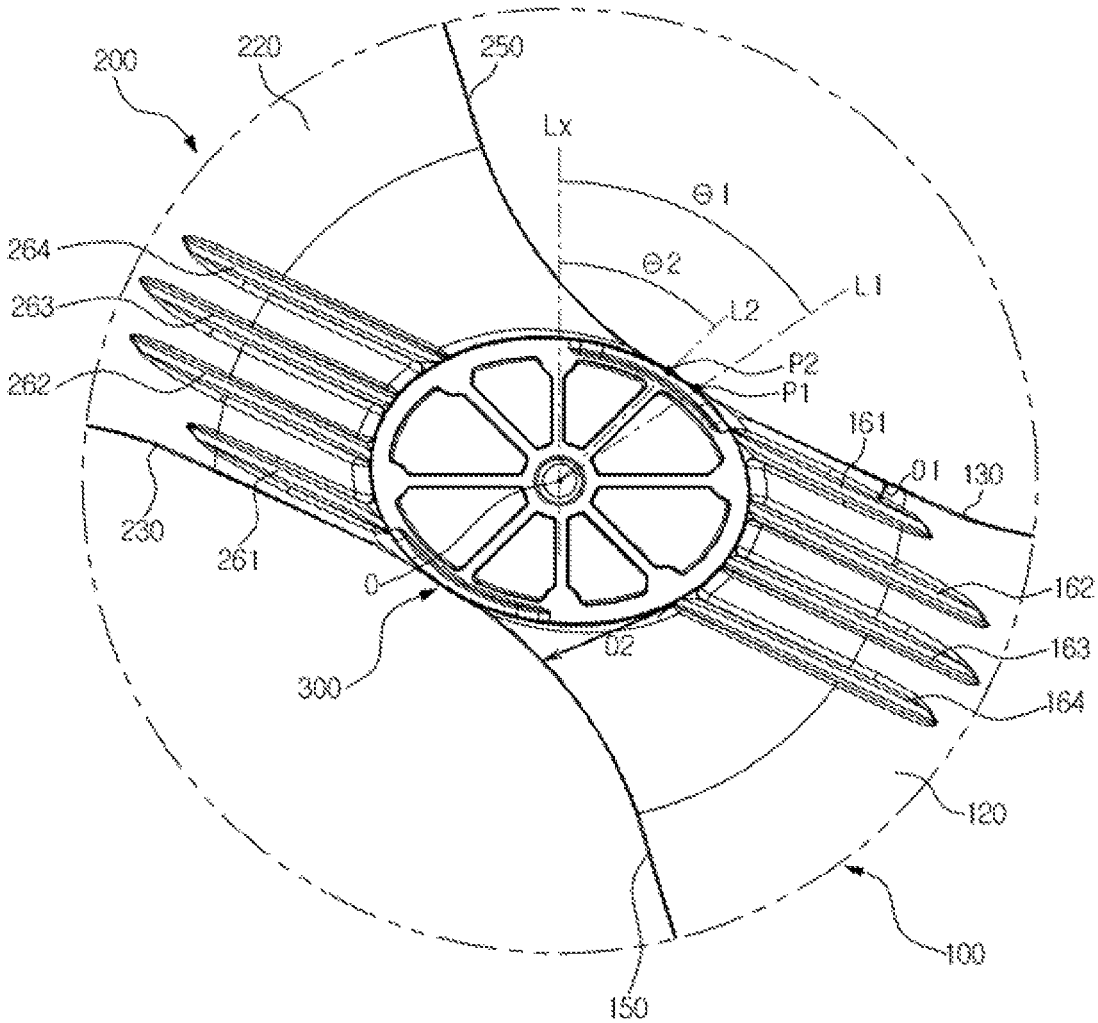
FIG. 5 is an enlarged rear view of a hub of the propeller fan of FIG. 1.
Figure 6:
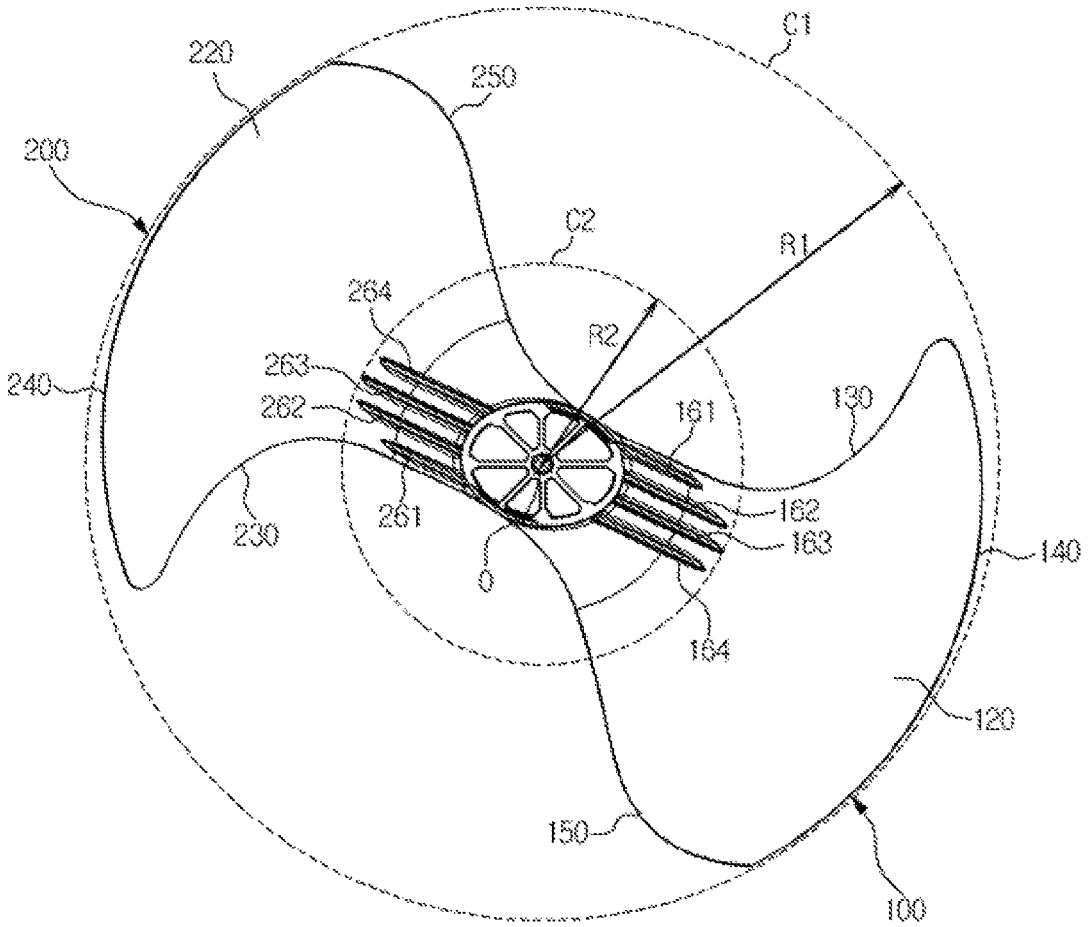
FIG. 6 is a rear view of the propeller fan of FIG. 1, which illustrates the sizes of reinforcement ribs.
Figure 7:
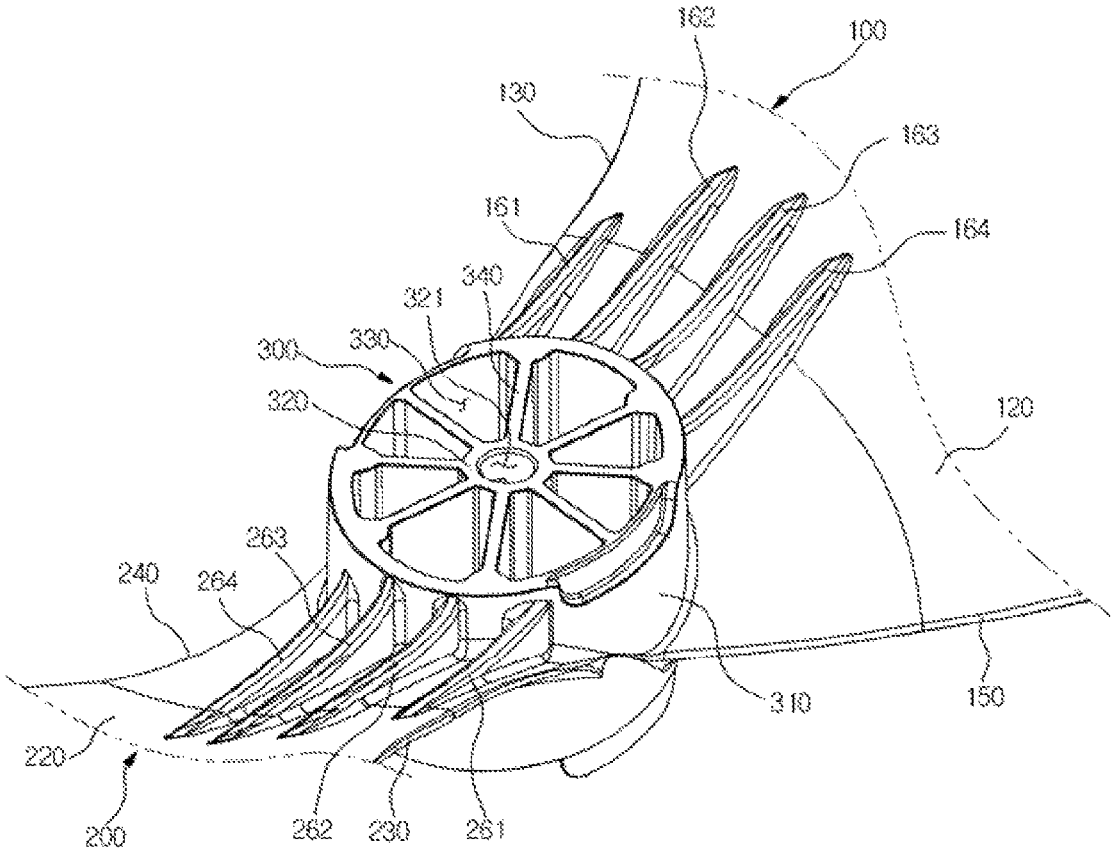
FIG. 7 is an enlarged perspective view of the hub of the propeller fan of FIG. 1.

FIG. 1 is a side view of a propeller fan according to an embodiment, FIG. 2 is a front perspective view of the propeller fan illustrated in FIG. 1, FIG. 3 is a rear perspective view of the propeller fan of FIG. 1, FIG. 4 is a rear view of the propeller fan of FIG. 1, FIG. 5 is an enlarged rear view of a hub of the propeller fan of FIG. 1, FIG. 6 is a rear view of the propeller fan of FIG. 1, which illustrates the sizes of reinforcement ribs, and FIG. 7 is an enlarged perspective view of the hub of the propeller fan of FIG. 1.

Referring to FIGS. 1 through 7, a propeller fan 1 according to an embodiment includes a hub 300 that is formed in the center of the propeller fan 1 and is coupled to a rotation shaft 441 of a driving motor (see 440 of FIG. 8) and a plurality of wings 100 and 200 that extend from the hub 300 to an outer side of the hub 300.

The hub 300 may be stably coupled to the rotation shaft 441 by a screw fastening structure and receives torque from the rotation shaft 441. The hub 300 includes an axial coupling portion 320 having an axial coupling hole 321 into which the rotation shaft 441 is inserted and a sidewall portion 310 having an oval shape with a long radius Y and a short radius X in an axial direction.

In this case, a cavity 330 is formed between the axial coupling portion 320 and the sidewall portion 310, and the axial coupling portion 320 and the sidewall portion 310 are connected to each other by a plurality of support ribs 340. The cavity 330 is formed between the axial coupling portion 320 and the sidewall portion 310 so that the whole weight of the hub 300 can be reduced.

The plurality of wings 100 and 200 include a first wing 100 and a second wing 200. Each of the first wing 100 and the second wing 200 extends from the sidewall portion 310 of the hub 300 to the outer side of the hub 300.

The first wing 100 and the second wing 200 are provided to have the same shape and are disposed symmetrical to each other based on the hub 300. As illustrated in FIG. 1, the first wing 100 and the second wing 200 are provided to have a gentle slope so as to allow air in the rear R of the propeller fan 1 to blow toward the front F in the axial direction.

As illustrated in FIG. 4, the first wing 100 includes a leading edge 130 that is formed in the front F of the propeller fan 1 in a rotation direction S of the propeller fan 1 and allows air to flow into the propeller fan 1, a trailing edge 150 that is formed in the rear R of the propeller fan 1 in the rotation direction S of the propeller fan 1 and allows air to flow out from the propeller fan 1, and a tip edge 140 that connects the leading edge 130 and the trailing edge 150 and has an approximately circular arc shape. Thus, edges of the first wing 100 are successively formed by the leading edge 130, the tip edge 140, and the trailing edge 150.

The first wing 100 includes a positive pressure side 110 in the front F of the propeller fan 1 and a negative pressure side 120 that is opposite to the positive pressure side 110. The positive pressure side 110 and the negative pressure side 120 are surrounded by the leading edge 130, the tip edge 140, and the trailing edge 150.

Likewise, the second wing 200 also includes a leading edge 230 that is formed in the front F of the propeller fan 1 in the rotation direction S of the propeller fan 1 and allows air to flow into the propeller fan 1, a trailing edge 250 that is formed in the rear R of the propeller fan 1 in the rotation direction S of the propeller fan 1 and allows air to flow out from the propeller fan 1, and a tip edge 240 that connects the leading edge 230 and the trailing edge 250 and has an approximately circular arc shape. Thus, edges of the second wing 200 are successively formed by the leading edge 230, the tip edge 240, and the trailing edge 250.

The second wing 200 includes a positive pressure side 210 in the front F of the propeller fan 1 and a negative pressure side 220 that is opposite to the positive pressure side 210. The positive pressure side 210 and the negative pressure side 220 are surrounded by the leading edge 230, the tip edge 240, and the trailing edge 250.

As described above, the hub 300 of the propeller fan 1 has the oval shape with the long radius Y and the short radius X in the axial direction. For example, the oval shape may be a shape that satisfies the equation of $1.1X<Y<1.4X$.

Also, as illustrated in FIG. 4, a virtual extension line Ly of the long radius Y of the hub 300 may be provided to cross the leading edges 130 and 230 of the plurality of wings 100 and 200, and a virtual extension line Lx of the short radius X of the hub 300 may be provided to cross the trailing edges 150 and 250 of the plurality of wings 100 and 200.

For example, the virtual extension line Ly of the long radius Y of the hub 300 may cross the leading edge 130 of the first wing 100 at a contact point Py1 and a contact point Py2 and may cross the leading edge 230 of the second wing 200 at a contact point Py3 and a contact point Py4.

Also, the virtual extension line Lx of the short radius X of the hub 300 may cross the trailing edge 150 of the first wing 100 at a contact point Px1 and may cross the trailing edge 250 of the second wing 200 at a contact point Px2.

The shape of the hub 300 is formed in such a way that lengths of reinforcement ribs 260 and 360 that will be described below are appropriately maintained and unnecessary portions to which the reinforcement ribs 260 and 360 are not connected are compressed, so as to maximize a reduction in weight and material cost of the propeller fan 1 within a range in which sufficient stiffness is provided to the plurality of wings 100 and 200.

Reinforcement ribs 160, 161, 162, 163, 164, 260, 261, 262, 263, and 264 of the propeller fan 1 according to an embodiment are used to reinforce stiffness to the plurality of wings 100 and 200. The reinforcement ribs 160, 161, 162, 163, 164, 260, 261, 262, 263, and 264 may extend from the sidewall portion 310 of the hub 300 and may protrude from the plurality of wings 100 and 200.

Reference numerals 160, 161, 162, 163, and 164 represent reinforcement ribs formed on the first wing 100. As illustrated in FIG. 5, the reinforcement rib 161, the reinforcement rib 162, the reinforcement rib 163, and the reinforcement rib 164 may be successively formed in a direction from the leading edge 130 to the trailing edge 150. When there is no need to differentiate the reinforcement ribs 161, 162, 163, and 164 in the drawings, they are indicated as 160.

Likewise, reference numerals 260, 261, 262, 263, and 264 represent reinforcement ribs formed on the second wing 200. As illustrated in FIG. 5, the reinforcement rib 261, the reinforcement rib 262, the reinforcement rib 263, and the reinforcement rib 264 may be successively formed in a direction from the leading edge 230 to the trailing edge 250. When there is no need to differentiate the reinforcement ribs 261, 262, 263, and 264 in the drawings, they are indicated as 260.

Of course, numbers of the reinforcement ribs 161, 162, 163, 164, 261, 262, 263, and 264 are not limited thereto and may be modified in various ways depending on a design specification.

However, in terms of positions of the reinforcement ribs 161, 162, 163, 164, 261, 262, 263, and 264, the reinforcement ribs 161, 162, 163, 164, 261, 262, 263, and 264 may be formed closer to the leading edges 130 and 230 than the trailing edges 150 and 250.

This is because, when the wings 100 and 200 rotate, larger loads are applied to the leading edges 130 and 230 than to the trailing edges 150 and 250, and thus the risk of damage of the leading edges 130 and 230 is larger than that of the trailing edges 150 and 250.

For example, as illustrated in FIG. 5, in the first wing 100, a distance D1 between the reinforcement rib 161 that is positioned closest to the leading edge 130 and the leading edge 130 may be smaller than a distance D2 between the reinforcement rib 164 that is positioned closest to the trailing edge 150 and the trailing edge 150.

As described above, the hub 300 of the propeller fan 1 according to an embodiment is provided to have the oval shape in the axial direction so that the virtual extension line Ly of the long radius Y of the hub 300 crosses the leading edges 130 and 230 of the plurality of wings 100 and 200 and the virtual extension line Lx of the short radius X of the hub 300 crosses the trailing edges 150 and 250 of the plurality of wings 100 and 200.

Thus, the hub 300 may have a shape with a minimum size within a range in which the reinforcement ribs 161, 162, 163, 164, 261, 262, 263, and 264 that extend from the hub 300 and are formed at the leading edges 130 and 230 provide sufficient stiffness to the plurality of wings 100 and 200.

As illustrated in FIG. 6, the reinforcement ribs 161, 162, 163, 164, 261, 262, 263, and 264 may extend to a predetermined radius R2 based on a virtual rotation axis O so as to provide sufficient stiffness to the plurality of wings 100 and 200.

For example, the equation of $0.33<R2/R1<0.45$ may be established between the radius R2 of a smallest circle C2 having a center of the virtual rotation axis O of the propeller fan 1 and including the reinforcement ribs 161, 162, 163, 164, 261, 262, 263, and 264 and a radius R1 of a smallest circle C1 having a center of the virtual rotation axis O of the propeller fan 1 and including the wings 100 and 200 inside the circle C1.

In an embodiment, the reinforcement ribs 161, 162, 163, 164, 261, 262, 263, and 264 are formed at the negative pressure sides 120 and 220 of the plurality of wings 100 and 200. However, aspects of embodiments are not limited thereto, and the reinforcement ribs 161, 162, 163, 164, 261, 262, 263, and 264 may be formed at the positive pressure sides 110 and 210 or at both of the positive pressure sides 110 and 210 and the negative pressure sides 120 and 220.

Since supplementary stiffness is provided to the plurality of wings 100 and 200 by the reinforcement ribs 161, 162, 163, 164, 261, 262, 263, and 264, the hub 300 may stably support the plurality of wings 100 and 200 even though it has a smaller size than a hub having no reinforcement ribs 161, 162, 163, 164, 261, 262, 263, and 264.

For example, as illustrated in FIG. 4, if a radius of a smallest circle C1 having a center of the virtual rotation axis O of the propeller fan 1 and including the wings 100 and 200 inside the circle C1 is R1, the relationship between the long radius Y of the hub 300 and R1 may satisfy the equation of $3.5Y<R1<6.5Y$.

In this way, the whole size of the hub 300 decreases so that the whole weight of the propeller fan 1 can be reduced compared to the related art. Furthermore, as described above, the cavity 330 is formed in the hub 300 so that the weight of the propeller fan 1 can be further reduced.

As illustrated in FIG. 5, the leading edge 130 of the first wing 100 and the trailing edge 250 of the second wing 200 do not cross each other. Likewise, the trailing edge 150 of the first wing 100 and the leading edge 230 of the second wing 200 do not cross each other.

For example, the leading edge 130 of the first wing 100 crosses the hub 300 at a contact point P1, the trailing edge 250 of the second wing 200 crosses the hub 300 at a contact point P2, and the contact point P1 and the contact point P2 do not coincide with each other.

If an angle between a virtual line L1 that connects the virtual rotation axis O of the propeller fan 1 and the contact point P1 and the virtual extension line Lx of the short radius X of the hub 300 is θ1 and an angle between a virtual line L2 that connects the virtual rotation axis O of the propeller fan 1 and the contact point P2 and the virtual extension line Lx of the short radius X of the hub 300 is θ2, θ1 may be in the range of about 40 to 60 degrees, and θ2 may be in the range of about 30 to 50 degrees.

The propeller fan 1 may be integrally injection molded using a composite polypropylene (PP) resin.

Figure 8:
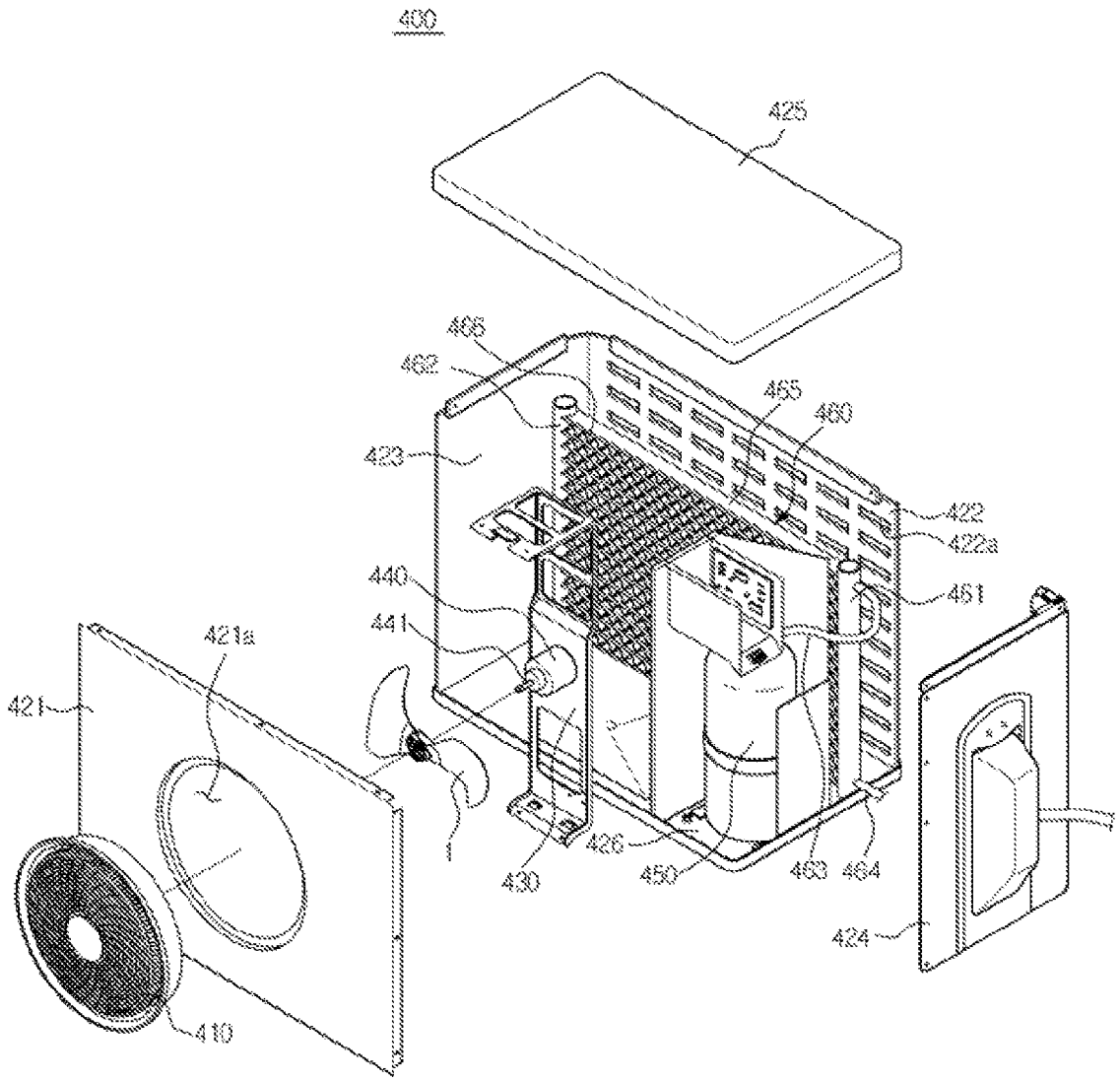
FIG. 8 is a view illustrating an outdoor unit of an air conditioner to which the propeller fan of FIG. 1 is applied.

FIG. 8 is a view illustrating an outdoor unit of an air conditioner to which the propeller fan of FIG. 1 is applied.

Referring to FIG. 8, an outdoor unit 400 includes a box-shaped body. The body may be formed by combining a front panel 421, a rear panel 422, both side panels 423 and 424, a top panel 425, and a bottom panel 426.

The rear panel 422 and one side panel 423 may have a structure in which one panel is bent, and suction ports 422*a* through which outdoor air is absorbed are formed in the rear panel 422.

A discharge port 421*a* through which air is discharged to an outside of the body is formed in the front panel 421, and a fan guard 410 that prevents external foreign substances from intruding into the body may be coupled to the discharge port 421*a*.

A compressor 450, a heat exchanger 460, and a blower may be disposed in the body. The blower may include a propeller fan 1 and the driving motor 440 for driving the propeller fan 1. The blower may be fixed to a support member 430, and the support member 430 may be fixed to the body when top and bottom ends of the support member 430 are coupled to the top panel 425 and the bottom panel 426 of the body.

The heat exchanger 460 may include a first header 461 and a second header 462 each having a space formed therein, a plurality of tubes 465 that connect the first header 461 and the second header 462, and heat-exchanging fins 466 that contact the plurality of tubes 465.

A high-temperature, high-pressure refrigerant compressed by the compressor 450 may flow into the heat exchanger 460 via a first connection pipe 463, and a refrigerant that passes through the heat exchanger 460 and is condensed may be guided to an expansion valve (not shown) via a second connection pipe 464.

Through this configuration, air that forcibly flows due to the blower may be absorbed via the suction ports 422*a*, may pass through the heat exchanger 460, may absorb heat, and may be discharged to the outside of the body via the discharge port 421*a*.

According to embodiments, a propeller fan in which the weight of the propeller fan can be reduced and material cost thereof can be reduced, can be provided.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A propeller fan comprising:

a hub that is coupled to a rotation shaft of a driving motor; and a plurality of wings that extend from the hub to an outer side of the hub and form a flow of air in an axial direction, wherein the hub has an oval shape with a first radius and a second radius perpendicular to the axial direction, the first radius being greater than the second radius, wherein the rotation shaft is coupled to a central axis of the hub, wherein the first radius extends along a longest straight line path between a circumferential point on the oval shaped hub and the central axis, wherein the second radius extends along a shortest straight line path between a circumferential point on the oval shaped hub and the central axis, wherein the longest straight line path is perpendicular to the shortest straight line, wherein each of the wings comprises a leading edge that is positioned in a front of a rotation direction, a trailing edge that is positioned in a rear of the rotation direction, and a tip edge that connects the leading edge and the trailing edge, and wherein a virtual extension line of the first radius of the hub crosses the leading edge of the wing twice, and a virtual extension line of the second radius of the hub crosses the trailing edge of the wing.

2. The propeller fan according to claim 1, further comprising at least one reinforcement rib that extends from the hub and protrudes from a surface of each of the plurality of wings.

3. The propeller fan according to claim 2, wherein:

the at least one reinforcement rib includes a plurality of reinforcement ribs;

the reinforcement ribs are provided spaced apart from each other by a predetermined distance successively in a direction from the leading edge to the trailing edge, and a distance between the leading edge and a reinforcement rib that is closest to the leading edge is smaller than a distance between the trailing edge and a reinforcement rib that is closest to the trailing edge.

4. The propeller fan according to claim 2, wherein, if a radius of a virtual smallest circle having a center of a rotation axis and including the wings in the virtual smallest circle is R1 and a radius of a virtual smallest circle having a center of the rotation axis and including the at least one reinforcement rib is R2, the equation of $0.33<R2/R1<0.45$ is satisfied.

5. The propeller fan according to claim 2, wherein the at least one reinforcement rib is not formed at a positive pressure side of the wing but is formed only at a negative pressure side of the wing.

6. The propeller fan according to claim 1, wherein, if the first radius of the hub is Y and the second radius of the hub is X, the equation of $1.1X<Y<1.4X$ is satisfied.

7. The propeller fan according to claim 1, wherein, if the first radius of the hub is Y and a radius of a virtual smallest circle having a center of a rotation axis and including the wings in the virtual smallest circle is R1, the equation of $3.5Y<R1<6.5Y$ is satisfied.

8. The propeller fan according to claim 1, wherein:

the plurality of wings comprise a first wing and a second wing, and the leading edge of the first wing and the trailing edge of the second wing do not cross each other, and the trailing edge of the first wing and the leading edge of the second wing do not cross each other.

9. The propeller fan according to claim 1, wherein the hub comprises a sidewall portion in which the plurality of wings extend and a cavity that is formed in the sidewall portion.

10. The propeller fan according to claim 9, wherein the hub comprises an axial coupling portion to which a rotation shaft of a motor is coupled and at least one support rib that connects the axial coupling portion and the sidewall portion.

11. The propeller fan according to claim 1, wherein the propeller fan is integrally injection molded using a composite polypropylene (PP) resin.

12. A propeller fan comprising:

a plurality of wings each having a leading edge that is positioned in a front of a rotation direction, a trailing edge that is positioned in a rear of the rotation direction, and a tip edge that connects the leading edge and the trailing edge, and forming a flow of air in an axial direction;

a hub that is formed between the plurality of wings is coupled to a rotation shaft of a driving motor and receives torque, the hub having an oval shape with a first radius and a second radius perpendicular to the axial direction, wherein a virtual extension line of the first radius crosses the leading edge of the wing and a virtual extension line of the second radius crosses the trailing edge of the wing, the first radius being greater than the second radius; and at least one reinforcement rib that extends from the hub and protrudes from the wings, wherein the rotation shaft is coupled to a central axis of the hub, wherein the first radius extends along a longest straight line path between a circumferential point on the oval shaped hub and the central axis, wherein the second radius extends along a shortest straight line path between a circumferential point on the oval shaped hub and the central axis, wherein the longest straight line path is perpendicular to the shortest straight line path, and wherein a virtual extension line of the first radius of the hub crosses the leading edge of the wing twice, and a virtual extension line of the second radius of the hub crosses the trailing edge of the wing.

13. The propeller fan of claim 12, wherein the at least one enforcement rib comprises a plurality of reinforcement ribs, wherein the reinforcement ribs are formed closer to the leading edge than the trailing edge.

14. An air conditioner comprising:

a body;

a heat exchanger disposed in the body;

a propeller fan that allows air inside the body to forcibly flow; and a driving motor that drives the propeller fan, wherein the propeller fan comprises:

a hub that is coupled to a rotation shaft of the driving motor; and a plurality of wings that extend from the hub to an outer side of the hub and form a flow of air in an axial direction, and the hub has an oval shape with a first radius and a second radius perpendicular to the axial direction, the first radius being greater than the second radius, wherein the rotation shaft is coupled to a central axis of the hub, wherein the first radius extends along a longest straight line path between a circumferential point on the oval shaped hub and the central axis, wherein the second radius extends along a shortest straight line path between a circumferential point on the oval shaped hub and the central axis, wherein the longest straight line path is perpendicular to the shortest straight line path, wherein each of the plurality of wings comprises a leading edge that is positioned in a front of a rotation direction, a trailing edge that is positioned in a rear of the rotation direction, and a tip edge that connects the leading edge and the trailing edge, and wherein a virtual extension line of the first radius of the hub crosses the leading edge of the wing twice, and a virtual extension line of the second radius of the hub crosses the trailing edge of the wing.

15. The air conditioner according to claim 14, further comprising at least one reinforcement rib that extends from the hub and protrudes from a surface of the wing.

* * * * *